United States Patent [19]

Staats

[11] 4,265,036

[45] May 5, 1981

[54] BUCKET DREDGING AND CONVEYING SYSTEM

[76] Inventor: William J. Staats, 4007 Orchard Hts. Rd., NW., Salem, Oreg. 97304

[21] Appl. No.: 23,157

[22] Filed: Mar. 23, 1979

[51] Int. Cl.[3] ..... E02F 5/28; E02F 7/02; E02F 9/18; E02F 3/44

[52] U.S. Cl. ..... 37/71; 37/183 R; 175/88; 175/161; 175/238; 414/564; 414/625; 414/673

[58] Field of Search ..... 37/183 R, 183 A, 184–188, 37/189, 71; 175/238, 161, 88; 173/147, 151; 414/564, 133, 673, 138, 143, 626, 625

[56] References Cited

U.S. PATENT DOCUMENTS

| | | | |
|---|---|---|---|
| 395,502 | 1/1889 | Morris | 414/673 X |
| 3,012,619 | 12/1961 | Farque | 173/147 X |
| 3,306,476 | 2/1967 | McMillan | 37/190 X |
| 3,704,796 | 12/1972 | Dedons et al. | 414/133 X |
| 3,726,349 | 4/1973 | Heusler et al. | 175/238 X |
| 3,757,439 | 9/1973 | Khaitovitch | 37/190 X |
| 4,049,064 | 9/1977 | Chubb et al. | 173/147 |
| 4,106,225 | 8/1978 | Schnabel, Jr. | 37/184 |

FOREIGN PATENT DOCUMENTS

| | | | |
|---|---|---|---|
| 1280759 | 10/1968 | Fed. Rep. of Germany | 175/88 |
| 1484669 | 2/1969 | Fed. Rep. of Germany | 175/238 |
| 2262920 | 6/1974 | Fed. Rep. of Germany | 37/71 |

*Primary Examiner*—Clifford D. Crowder
*Attorney, Agent, or Firm*—Kolisch, Hartwell & Dickinson

[57] ABSTRACT

A method and apparatus for removing bottom material from beneath the surface of a body of water includes a floatable base upon which a tower is mounted for extending vertically upwardly therefrom. A rigid, elongate member having a bucket is connected to the tower and shiftable relative thereto by means of a power-driven motor mounted adjacent the tower. The motor is operable for selectively shifting the elongate member in a substantially vertical direction to effect raising and lowering of the bucket. A carriage is connected by cables to the motor and is operable for substantially vertical shifting along guides provided on the tower. The elongate member is connected to the carriage and suspended therefrom and is also pivotally connected to the carriage to permit pivotal movement of the elongate member about a horizontal axis extending generally perpendicularly to the longitudinal axis of the elongate member. A second carriage is provided on an opposite side of the tower and is operable for substantially vertical shifting along second guides provided on the other side. A counterweight is connected to the second carriage and suspended therefrom to aid in the raising of a bucket load of bottom material.

17 Claims, 13 Drawing Figures

BUCKET DREDGING AND CONVEYING SYSTEM

BACKGROUND AND SUMMARY OF THE INVENTION

The present invention relates to dredging apparatus, and more particularly to a novel method and apparatus for removing bottom material from beneath the surface of a body of water in an automatic manner along predetermined paths.

Generally, known dredging apparatus include some type of barge construction upon which is mounted a boom member for extending a cable, with a bucket mounted thereon, over the water so that the bucket may be positioned adjacent the bottom surface of the water. The cable is power driven and additional means may be provided for operating or deploying the bucket. However, it can be readily appreciated that with a bucket suspended by a cable, no precise control in positioning the bucket adjacent the bottom surface is available. Additionally, the bucket is limited in the degree to which it can penetrate the bottom surface because there is no means for driving the bucket into the bottom other than its own weight. Of course, it can also be seen that a bucket, suspended as described above, will tend to twist or reorient, depending on the configuration or contour of the bottom surface. The result is that conventional dredging apparatus do not provide an accurate method for positioning a bucket on the bottom surface and for driving the bucket thereinto while substantially constraining the bucket from rotation about a vertical axis.

In certain dredging operations, it is desirable to accurately control the position of a bucket on the bottom surface during digging so that a predetermined, continuous path may be dredged. Unfortunately, with conventional dredging apparatus as described above, it is difficult, if not entirely impossible, to continuously position the dredge so that accurate removal of bottom material along predetermined paths may be effected. Conventional dredging apparatus generally are anchored to the bottom surface or along a shore by means of guy lines, and removal of the lines is necessary in order to reposition the dredge. Removal and repositioning of the guy lines is time consuming and burdensome and does not ensure precise relocation of the apparatus.

Additionally, in dredging operations which contemplate sand and gravel reclamation from inland pits, it is especially desirable to have a dredging apparatus which may be continuously operated along selected, predetermined paths so that bottom material may be continuously and consecutively removed over a given area. This is necessary in order to provide economically beneficial reclamation and to prevent unnecessary wastage.

Accordingly, it is a general object of the invention to provide a method and apparatus for removing material from beneath the surface of a body of water which includes a floatable base and a tower mounted thereon which extends vertically upwardly for mounting a rigid means having a bucket provided thereon. The rigid means is operable, by means of a power-driven means, for selective shifting in a substantially vertical direction to effect raising and lowering of the bucket so that the position of the bucket may be accurately controlled and also driven into the bottom surface. In order to accurately control the bucket positioning, a stabilizing means such as a carriage, is connected to the power-driven means and is shiftable in a vertical direction along vertical guides provided on the tower. The rigid means includes a pole or elongate member which extends downwardly from the carriage and upon which the bucket is mounted adjacent one end thereof.

Another object of the present invention is to provide an apparatus as described above, in which the elongate member is pivotally connected to the carriage so that it is permitted to pivotally move about a horizontal axis extending generally perpendicularly to the longitudinal axis of the elongate member. This construction provides an advantage because during downward shifting of the carriage in a vertical direction, the bucket will be driven or rammed into the bottom surface, and upon obtaining a bucket load, the base may be continuously advanced by virtue of the fact that the elongate member will swing relative to the direction of advancement.

Still another object of the present invention is to provide an apparatus, as described above, in which the bucket is pivotally connected to the elongate member for pivotal movement about another axis which also extends generally perpendicularly to the longitudinal axis of the elongate member so that the bucket may reorient depending upon the configuration of the bottom surface. Elaborating further, it can be appreciated that a typical bottom surface will have a nonuniform contour and in order for the bucket to be driven into the bottom surface so that a maximum amount of material may be obtained, it is necessary for the bucket to reorient about a generally horizontal axis of rotation so that a full bite may be taken.

Yet a further object of the present invention is to provide an apparatus, as described above, in which a first conveying means is positioned for extending over a portion of the water surface to which the base is connected. The base is operable for selective shifting therealong in a direction substantially parallel to the direction of conveyance of the first conveying means. Thus, upon shifting of the apparatus, the carriage, elongate member, and bucket may be successively advanced along a predetermined path in order to continuously remove material along the path. Advantageously, maximum material may be removed in order to more fully realize the potential of a bottom surface.

Still another object of the present invention is to provide an apparatus, as described above, further including a second conveying means disposed generally perpendicularly to said first conveying means with said first conveying means being connected thereto and operable for selective shifting along said second conveying means in a direction generally perpendicular to the direction of conveyance of the second conveying means. This construction results in an apparatus which may be selectively shifted or advanced in a first direction along the first conveying means for dredging material from the bottom surface along a predetermined path. Upon the apparatus reaching a preselected position along the first conveying means, the first conveying means may be selectively shifted along the second conveying means so that the apparatus may be shifted, in a reverse direction, along the first conveying means for dredging along a new predetermined path in a direction opposite to the first path. By suitable automatic positioning of the base relative to the first conveying means and suitable repositioning of the first conveying means relative to the second conveying means, any desired area of a bottom surface may be dredged. Advantageously, full realization of material from the bottom surface locale may be realized.

A still further object of the present invention is to provide an apparatus, as described above, in which a second carriage is provided on an opposite side of the tower which is connected to a counterweight. A cable construction, trained over winch drums, interconnects the carriages so that the counterweight facilitates raising of a loaded bucket. More particularly, it is contemplated that the second carriage and the counterweight, taken together, determine a total weight generally equal to the combined weight of the first carriage, the rigid member and the bucket together with approximately fifty percent (50%) of the weight of a bucket payload.

These and additional objects and advantages of the present invention will be more particularly understood from a consideration of the drawings and the following detailed description of the preferred embodiment.

DETAILED DESCRIPTION OF THE PREFERRED EMBODIMENT

Figure 1:
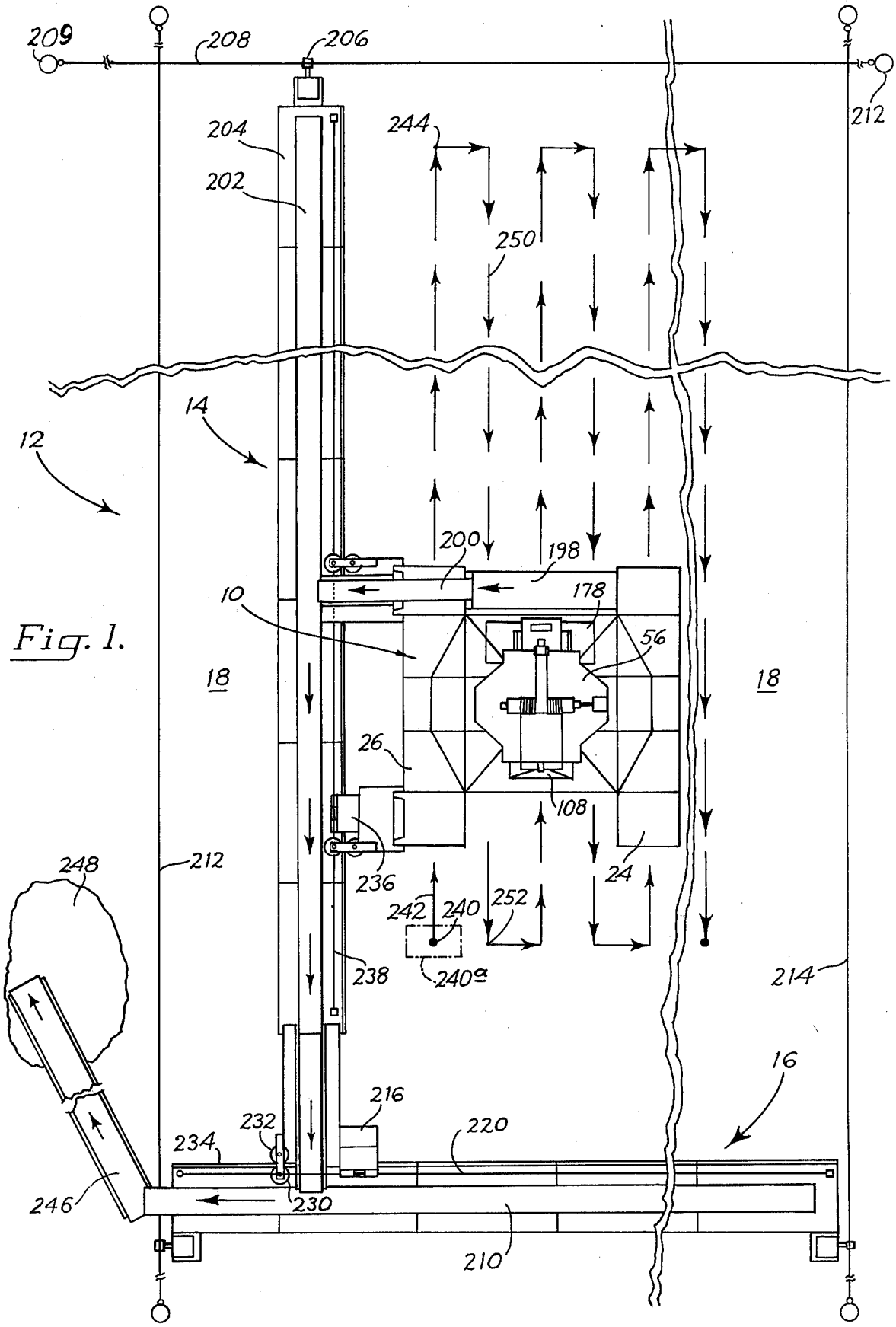
FIG. 1 is a top plan view of an apparatus according to the present invention and schematically illustrates positioning of interconnected first and second conveying means wherein a floatable base including a tower is connected to the first conveying means.

Turning now to the drawings, and referring initially to FIG. 1, there is illustrated in top plan view an apparatus, generally indicated at 10, operable for removing bottom material from beneath the surface of a body of water. Apparatus 10 is interconnected to a conveying apparatus, generally indicated at 12, which includes first conveying means 14 shiftably interconnected to a second conveying means 16. As can be seen, apparatus 10 and conveying apparatus 12 are positioned for floating on the upper surface of a body of water generally indicated at 18. Details of conveying apparatus 12 will be set forth after a description of apparatus 10 is completed.

Figures 2, 3:
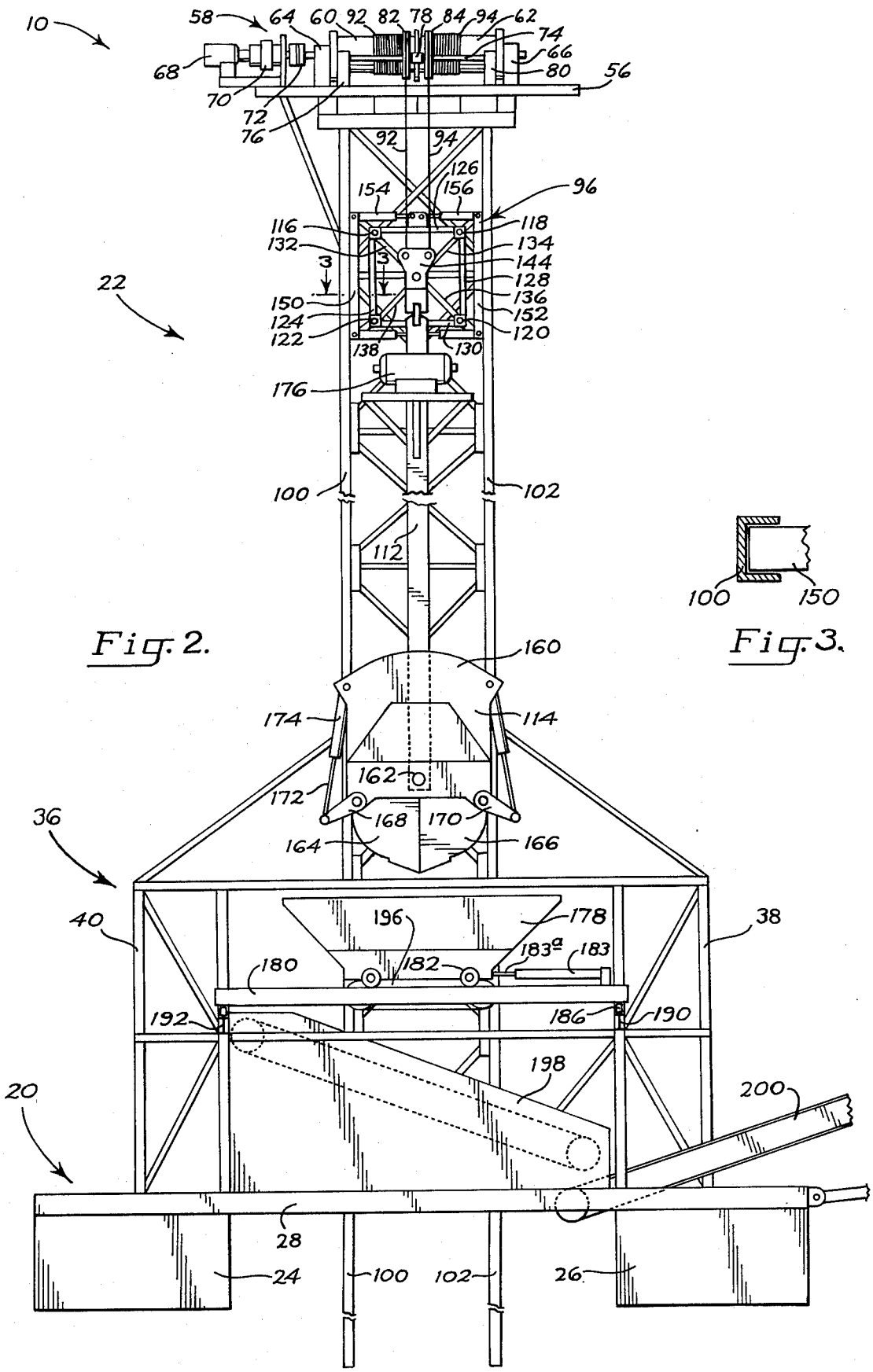
FIG. 2 is a front elevation view of the floatable base and tower and illustrates positioning of a bucket in a raised position.
FIG. 3 is a view taken along lines 3—3 of FIG. 2.
Figure 4:
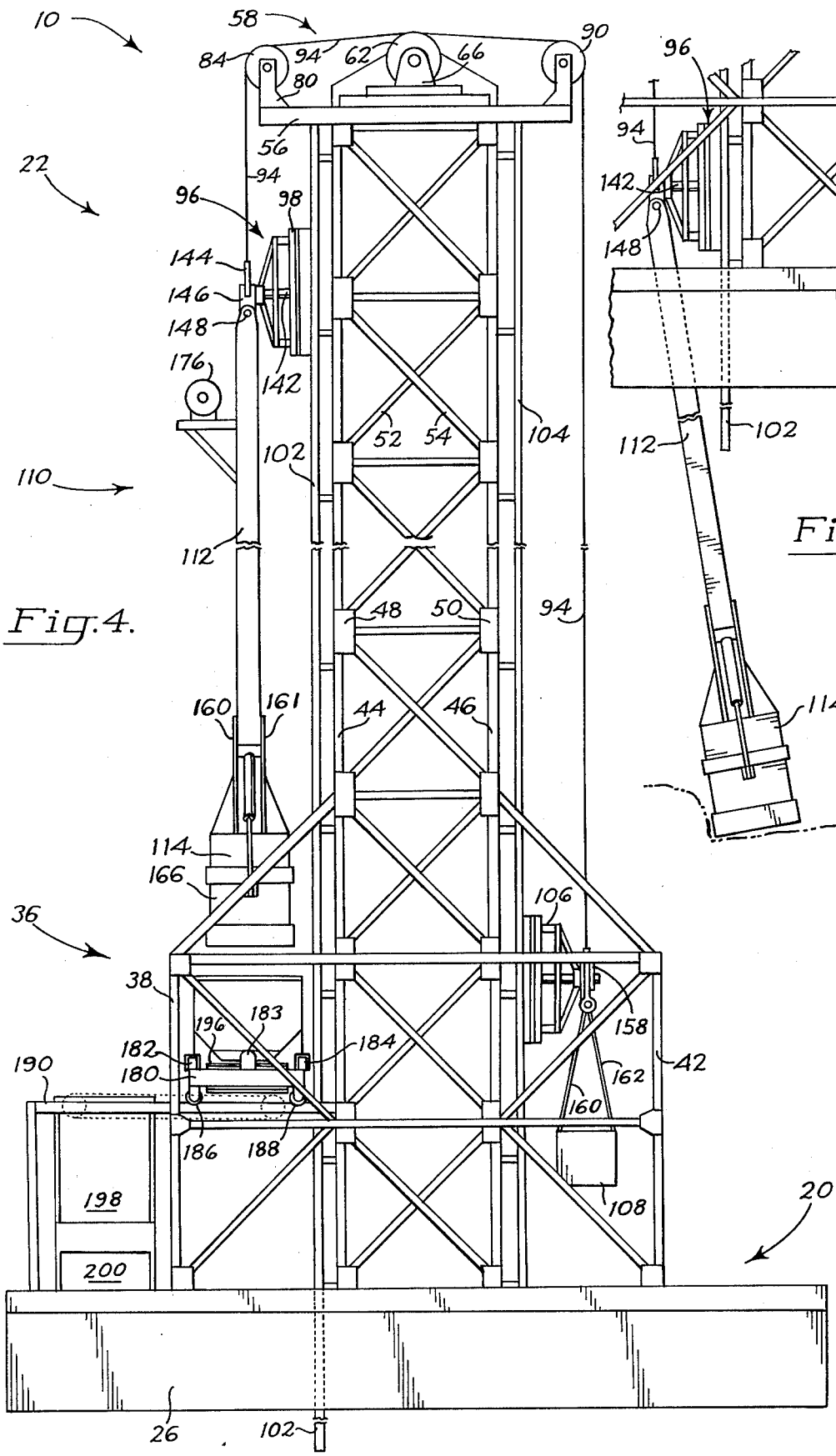
FIG. 4 is a side elevation view of the floatable base and tower and illustrates the bucket in raised position with the counterweight on the opposite side of the tower.
Figure 5:
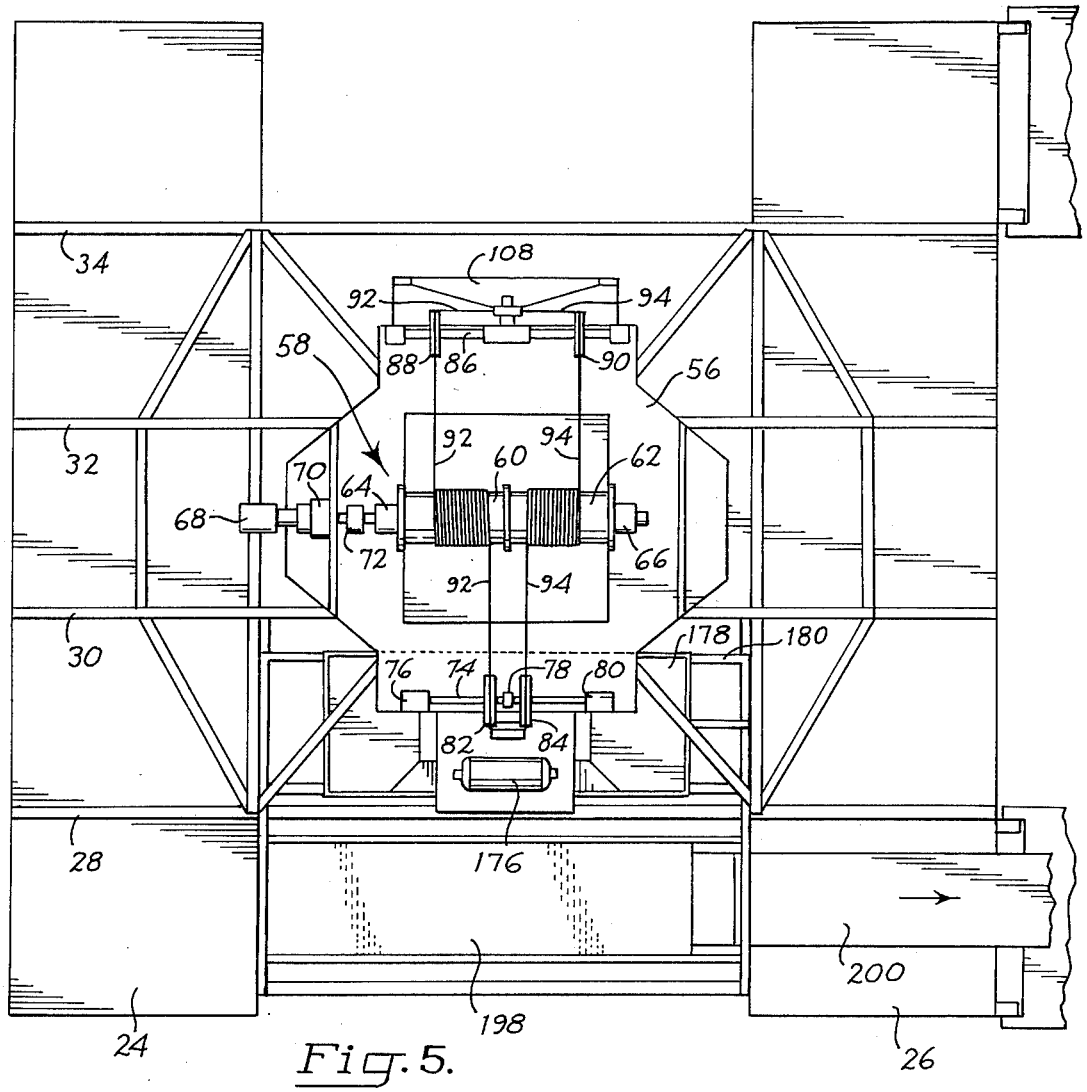
FIG. 5 is another top plan view of the float and tower illustrating positioning of equipment mounted on a platform provided on top of the tower.

Considering details of apparatus 10, reference is directed to FIGS. 2 and 4. As illustrated, apparatus 10 is provided with a bottom or floatable base means, generally indicated at 20, for providing a support structure for a tower means or tower generally indicated at 22. The tower is supported by floatable base means 20 and extends vertically upwardly therefrom. Considering floatable base means 20, it can be seen that it includes a pair of elongate, spaced-apart float members 24, 26 interconnected by suitable structural steel members, such as indicated at 28, 30, 32 and 34 (see FIG. 5). The structural steel members as shown in FIG. 5 serve to provide a rigid structure for interconnecting float members 24, 26 and also provide a base structure for mounting of tower 22.

Further details of tower 22 are shown in FIGS. 2 and 4, and it can be seen that a lower supporting frame construction, generally indicated at 36, includes uprights 38, 40, 42, etc., which serve to brace tower 22. The tower is formed of an interconnected steel construction of box-like configuration and includes spaced-apart, upwardly extending angle members, two of which are shown at 44, 46 (FIG. 4). Additional angle members are positioned on the other side of angle members 44, 46 (hidden in FIG. 4) and extend upwardly for forming the other side of tower 22. Each of the angle members is suitable interconnected by securing flanges, two of which are indicated at 48, 50 and suitable bracing struts such as indicated at 52, 54 provide a rigid, unitary construction.

Still considering FIGS. 2 and 4, it can be seen that on top of tower 22 there is provided a platform 56 which serves as a mounting for a power-driven means generally indicated at 58. With attention also directed to FIG. 5, it can be seen that power-driven means 58 includes a pair of drums 60, 62 aligned along their longitudinal axes and suitably supported in bearing mounts 64, 66, respectively. Also supported on platform 56 is a motor 68 (preferably hydraulically driven) operably driven through a gear box 70 and interconnected by means of a coupling 72 so as to simultaneously drive drums 60, 62 for selective rotation thereof. A brake, not specifically shown, is also provided on platform 56. Positioned at a forward end of platform 56 is a shaft 74 suitably mounted in bearing mounts 76, 78 and 80. Coaxially aligned on shaft 74 are a pair of sheaves or pulleys 82, 84 which are slidable along the longitudinal axis of shaft 74. Considering the rear of platform 56, it can be seen that another shaft 86 is suitably mounted on the platform and another pair of spaced-apart pulleys 88, 90 are coaxially mounted on shaft 86 and are slidable along the longitudinal axis thereof.

Trained around each of the drums is a cable which extends over the front and the rear of tower 22. For instance, trained around drum 60 is a cable 92 and trained around drum 62 is a cable 94. Cables 92, 94 extend forwardly of drums 60, 62 and are partially trained over pulleys 82, 84 to extend vertically downwardly for connection to a stabilizing means generally indicated at 96 (see FIGS. 2 and 4). Stabilizing means 96 is preferably constructed as a carriage 98 which is operable, upon suitable actuation of drums 60, 62 for substantially vertical shifting along a first pair of spaced-apart guide means 100, 102. The guide means are suitably connected to tower 22 and extend along its height and may also extend beneath the water surface, as illustrated. On the other side of tower 22, another or second pair of guide means are provided, one of which is indicated at 104 so that a second carriage 106 may be secured to cables 92, 94. The second carriage is also movable for substantially vertical shifting. A counterweight 108 is suitably suspended from carriage 106 for reasons to be described hereinafter.

Returning to a description of carriage 96, it can be seen that a rigid means, generally indicated at 110, includes an elongate member 112 suspended from the carriage. A clam-shell type bucket 114 is mounted on an opposite end of elongate member 12. Thus, it can be seen that upon suitable actuation of drums 60, 62, stabilizing means 96, which includes carriage 98, may be selectively shifted in a substantially vertical direction to effect raising and lowering of bucket 114. It must be realized that an important feature of the present invention, besides the vertical shifting, resides in the fact that stabilizing means 96 is mounted on tower 22 for substantially constraining twisting or rotation of bucket 114 about a vertical axis. This constraining feature is an important one and can be best appreciated from a consideration of FIGS. 2, 4, 8 and 9.

Figure 9:
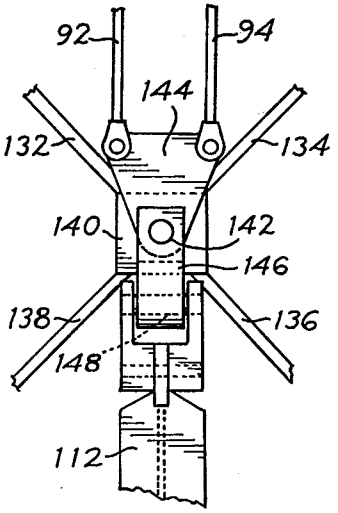
FIG. 9 is a side elevation view of the carriage illustrated in FIG. 8.
Figure 8:
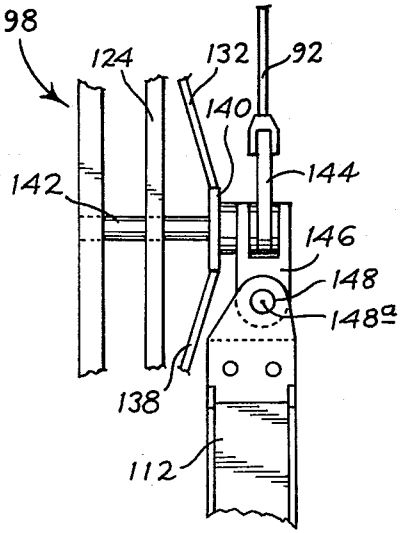
FIG. 8 is a partial view of a stabilizing means operable for vertical shifting on the tower, and illustrates interconnection of the stabilizing means to a rigid elongate member by means of a pivotal connection, the elongate member being connected to the bucket.

Elaborating further, and considering FIG. 2, it can be seen that carriage 98 is constructed as a box-like frame in which pins 116, 118, 120 and 122 form corner connections for joining frame members 124, 126, 128 and 130 (see FIG. 8 also). Extending from the pins are struts 132, 134, 136 and 138 which are connected to a thrust collar 140 (see FIG. 9). As also shown in FIG. 9, a pin 142 secured to carriage 98 extends outwardly and provides a pivotal mount for elongate member 112.

In further explanation, it can be seen that cables 92, 94 are pin-connected to a yoke member 144 which in turn is pivotally connected to pin 142. Extending downwardly from pin 142 and pivotally connected thereto is an interconnecting member 146 which serves as a mount for pivotally interconnecting an end of elongate member 112 by means of a pin 148.

Thus, as can be seen from a consideration of FIG. 4, elongate member 112 is pivotally connected, by means of pin 148, to carriage 98 so that the elongate member will be permitted to pivotally move about a horizontal axis extending generally perpendicularly to the longitudinal axis of the elongate member. As can be seen, elongate member 112 may pivot about a horizontal axis which is generally perpendicular to an axis 148*a* defined by pin 148. The importance of mounting yoke member 144 to accommodate spaced-apart connection of cables 92, 94 thereto, with the additional provision of pivotal mounting of yoke member 144 on pin 142, resides in the fact that substantially equal tension will be imparted to cables 92, 94 due to the load of carriage 96, elongate member 112, etc. In addition, if one of the cables should inadvertently become severed, yoke member 144 will rotate a given amount about pin 142 so that the line of action of the nonsevered cable is substantially aligned with the longitudinal axis of elongate member 112.

Returning to further consideration of the details of carriage 98, it can be seen that on opposite sides of the carriage there are provided slide elements 150, 152 which are suitably interconnected to pins 116, 122 and 118, 120, respectively. As shown in FIG. 3, guide means 100 is formed as a channel for receiving slide element 150. Guide means 102 and slide element 152 are similarly arranged. It is contemplated that each of the slide elements is provided with a friction-reducing outer layer, such as a skin of teflon. In addition, shock-absorbing means, two of which are indicated at 154, 156 are provided for cushioning impact between carriage 98 and guide means 100, 102.

Considering the opposite side of tower 122, as shown in FIG. 4, it can be seen that second carriage 106 is similarly constructed to carriage 98 and includes a yoke member 158 pin-connected to cables 92, 94. Counterweight 108 is suitably suspended by cables, two of which are shown at 160, 162 from carriage 106.

Thus, it should be appreciated that carriage 98 will substantially constrain rotation, about a vertical axis or an axis aligned with the longitudinal axis of elongate member 112, during vertical shifting of the carriage. Of course, as mentioned before, carriage 98 will shift only in a vertical direction. As a consequence, bucket 114 is substantially prevented from rotation about a vertical axis or an axis corresponding to the longitudinal axis of elongate member 112. This constraining feature of carriage 98 is extremely advantageous when it is realized that it is necessary to accurately locate bucket 114 so that a trench may be dug along a predetermined path without twisting or rotation of the bucket about a vertical axis. While elongate member 112 may be permitted to pivot at least somewhat about pins 142 and 148, the bucket is nonetheless constrained from twisting about a vertical axis by means of carriage 98. The shock-absorbing means permit slight reorientation of carriage 98 relative to guide means 100, 102, but only for the purpose of absorbing impacts when bucket 114 is driven into the bottom surface.

Figure 10:
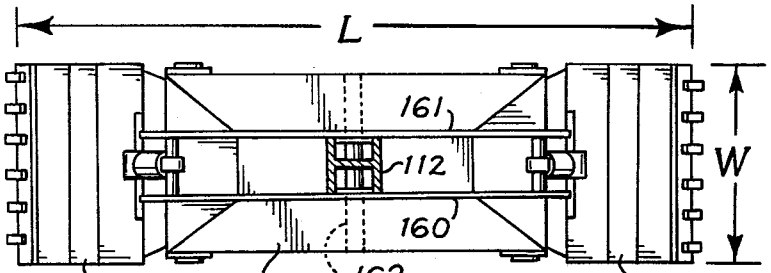
FIG. 10 is a top plan view of the bucket, illustrating its clam-shell halves or jaws in deployed position.

Another feature of the present invention resides in the pivotal connection of bucket 114 on elongate member 112. As can be seen from a consideration of FIG. 2, bucket 114 includes opposed, interconnected shroud sections 160, 161 (see FIG. 10) which are spaced apart and pivotally connected by means of a pin at 162 to the end of elongate member 112. A pair of clam-shell halves or toothed jaws 164, 166 are suitably interconnected by links 168, 170, respectively, to associated hydraulic cylinders. More particularly, it can be seen that link 168 is connected to an extendible-retractable rod 172 which is operable by means of a cylinder 174. Similarly, jaw 166 is connected to a cylinder and each cylinder is driven by means of a hydraulic pump and motor generally indicated at 176. Hydraulic pump 176 and motor (suitably covered so as to be water-tight) are interconnected by hoses (not shown) to the cylinders for selectively opening and closing jaws 164, 166. The important point to note is that bucket 114 is pivotally connected to elongate member 112 about pivotal connection 162 so that the bucket may pivot about an axis extending generally perpendicularly to the longitudinal axis of the elongate member. The importance of the above-described pivotal connection can be best appreciated from a consideration of FIGS. 10–12 which illustrate bucket 114 with jaws 164, 166 opened prior to a digging operation.

Figure 11:
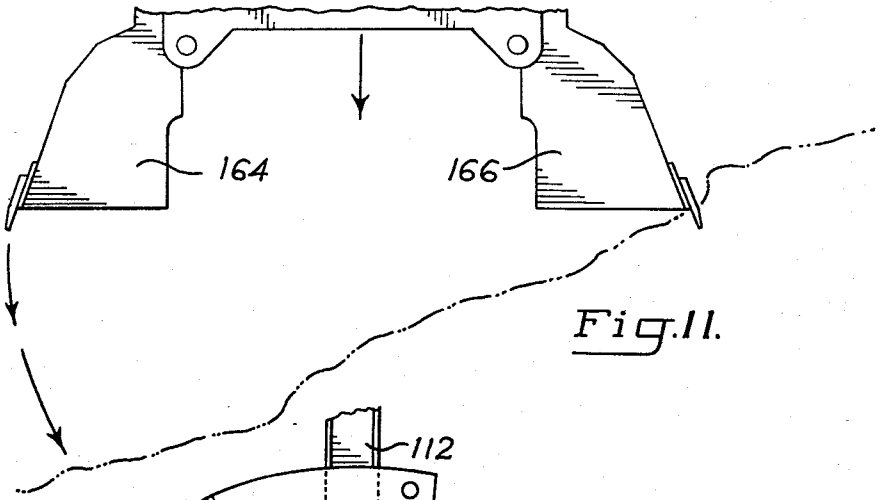
FIG. 11 is a view of a bucket portion, with its jaws extended, as a first jaw contacts an uneven bottom surface.
Figure 12:
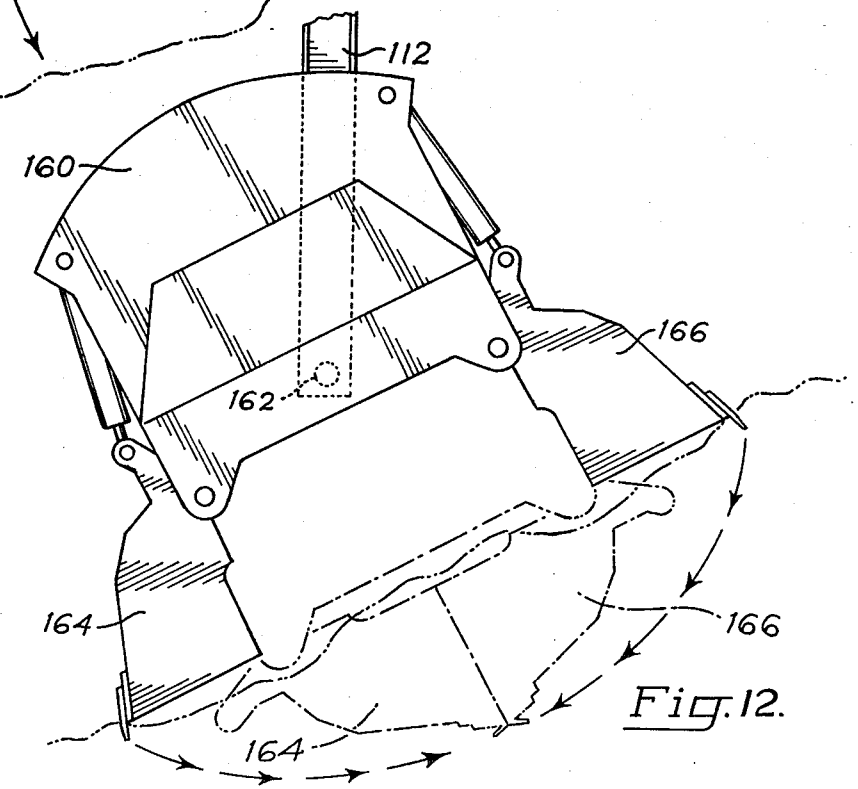
FIG. 12 is a view similar to FIG. 11 illustrating pivotal movement of the bucket about a pivot connection to the elongate member so that the bucket may be driven into the bottom surface for securing a load.

As shown in FIG. 11, bucket 114 is being extended or lowered downwardly for a digging operation, and it can be seen that the bottom surface is uneven. As bucket 114 first contacts the bottom surface with jaw 166, the bucket will tend to pivot in a counterclockwise direction so that jaw 164 is presented to face and contact the bottom surface, as shown in FIG. 12. With elongate member 112 forcing or ramming the jaws into the bottom surface, the jaws may be suitably actuated to dig a full load.

Figure 6:
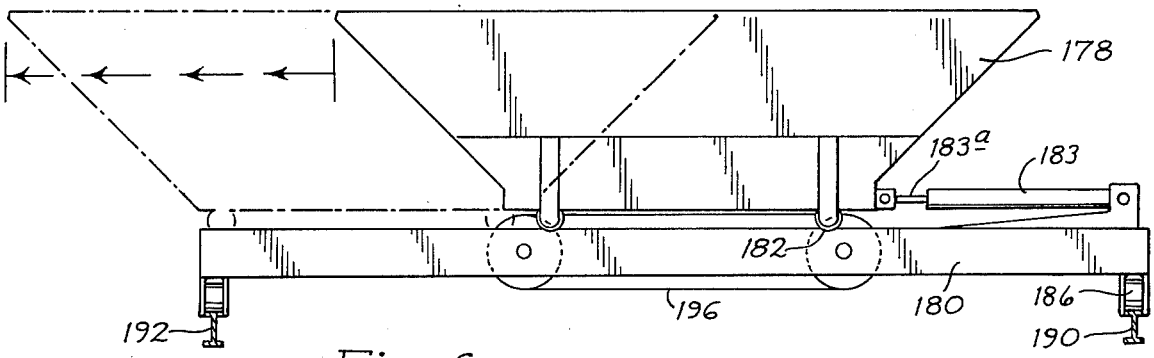
FIG. 6 is a side elevation view of a transfer cart illustrating its selective positioning for discharging a load received from the bucket.

Considering now further details of apparatus 10, reference is directed to FIG. 6 as well as to FIGS. 2 and 4. Initially considering FIGS. 2 and 4, it can be seen that a hopper or cart 178 is mounted on a transfer carriage 180 by means of wheels 182, 184, etc. A cylinder 183 is suitably connected by means of a rod 183*a* to one end of cart 178 and is operable for shifting the cart, to the left as shown in FIGS. 2 and 6, and for returning same to a load position on transfer carriage 180. As can be seen from a viewing of FIGS. 4 and 6, transfer carriage 180 is provided with wheels, two of which are shown at 186, 188 so that the cart may be selectively shifted along a pair of spaced-apart elevated rails 190, 192. More particularly, FIG. 4 illustrates cart 178 mounted on transfer carriage 180 and a mechanism (not shown) is connected to transfer cart 178 and is operable for selectively shifting same from a pre-spot position to a position for receiving a load discharged from bucket 114. As shown in FIG. 4, cart 178 is positioned for receiving a load and may be shifted to the left along rails 190, 192 to the pre-spot position. Additionally, FIG. 2 illustrates a discharge conveyor 196 positioned beneath cart 178. It is to be noted that cart 178 is provided with a screened bottom, and assuming it contains a load of material, shifting of the cart to the left by suitable actuation of rod 183*a* (see FIG. 2) will enable material to fall through the screen and be conveyed by conveyor 196 so as to fall on a transfer means such as conveyor 198. Conveyor 198 is suitably mounted on apparatus 10 and is positioned for transferring material deposited thereon onto another conveyor 200.

Turning to FIG. 1, a further explanation of apparatus 10 and its novel and advantageous interrelationship to conveying apparatus 12 will now be described. As mentioned previously, conveying apparatus 12 includes a first conveying means generally indicated at 14 which is provided with a conveyor belt 202 mounted on an elongate floating support indicated at 204. Floating support 204 is connected by means of a guide 206 to a guide line 208. The guide line is suitably anchored at its opposite ends to anchors 209, 212 which may be on the land or shore. Similarly, second conveying means 16 includes a conveyor belt 210 operable for conveyance toward the left, as shown in FIG. 1 and is suitably connected at its opposite ends to spaced-apart guide lines 212, 214.

Figure 7:
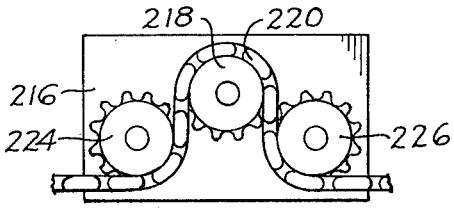
FIG. 7 is a schematic view of a drive unit for driving either the floatable base relative to the first conveying means or for driving the first conveying means relative to the second conveying means.

First conveying means 14 is provided with a drive unit, generally indicated at 216, which includes (see FIG. 7) a drive sprocket 218. The drive sprocket engages an elongate chain 220 which is stretched substantially across the length of second conveying means 16 and is secured at opposite ends thereto. Suitable idler sprockets are indicated at 224, 226. Positioned oppositely of drive unit 16 are a pair of spaced-apart wheels 230, 232 which engage a rail 234 provided on the second conveying means so that shifting of first conveying means 14, relative to second conveying means 16, by means of actuation of drive unit 216, will result in an even, substantially perpendicular, orientation of the first conveying means relative to the second conveying means.

Similarly, a drive unit 236 extends from suitable supports provided on float member 26 so that apparatus 10 may be selectively shifted in a direction generally parallel to the direction of conveyance of first conveying means 14. Drive unit 236 is operable for engaging a chain 238 provided on first conveying means 14 in a manner similar to that described with respect to drive unit 216 and chain 220.

OPERATION OF THE DREDGING APPARATUS

In a typical dredging operation using the method and apparatus of the present invention, it is contemplated that a predetermined area of bottom surface is to be removed generally at some predetermined depth. Thus, with reference made to FIG. 1, first conveying means 14 is positioned to the left adjacent the left-hand end of second conveying means 16 and apparatus 10 is positioned adjacent the lower end (as seen in FIG. 1) of first conveying means 14. Thus, bucket 114 is positioned above an initial starting or reference point indicated at 240, an outline of the bucket area being indicated at 240*a*. Cart 178 is positioned to the left in a pre-spot position (see FIG. 4) so that a free path for bucket lowering exists between float members 24, 26. Upon suitable actuation of motor 68, lines 92, 94 are paid out from drums 60, 62 so as to lower carriage 98. Lowering or carriage 98 also lowers elongate member 112 and bucket 114 until the bucket, with jaws 164, 166 deployed, strikes the bottom surface. Of course, it must be appreciated that elongate member 112, due to its weight concentrated along a specific line of action, serves to force or ram jaws 164, 166 into the bottom surface so that adequate penetration for developing full-bucket payload, upon closing of jaws 164, 166, will result.

The full weight of elongate member 112 and bucket 114 against the bottom surface results from counterweight 108 being "picked-off". This refers to the fact that as bucket 114 (with jaws 164, 166 deployed) strikes the bottom surface, motor 68 is operated so as to continue to raise the counterweight. This results in some slack in lines 92, 94 from drums 60, 62 to carriage 98. The net effect is to isolate the counterweight from elongate member 112 and bucket 114 (as well as carriage 98) to permit the full weight of the elongate member and bucket to be imparted against the bottom surface. This full weight, with the counterweight being "picked-off", serves to force the bucket and jaws into the bottom surface for full penetration.

Figure 4A:
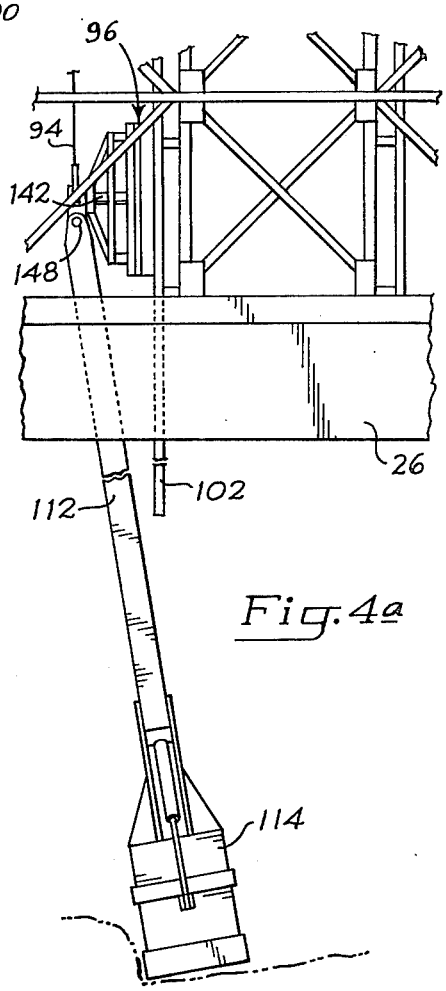
FIG. 4*a* is a partial view, similar to FIG. 4, showing a lowered bucket.

As mentioned previously, bucket 114 will not rotate or twist about a vertical axis or about the longitudinal axis of elongate member 112. This is because carriage 98, being mounted in guide means 100, 102 as described, substantially constrains any tendency for rotation. This feature is important when it is realized that it is contemplated that apparatus 10 will be continuously advanced. Stated differently, and with reference directed to FIG. 4*a*, it can be seen that bucket 114, with jaws 164, 166 containing a load, is being returned to the position shown in FIG. 4. Some degree of pivotal movement of elongate member 112 about pivot connection 148 is desirable to permit continuous movement of apparatus 10 so that the apparatus does not experience undue twisting loads as the bucket scrapes upwardly through a trench or hole.

Next, with bucket 114 positioned substantially as shown in FIG. 4, with a payload, cart 178 is shifted beneath the bucket and jaws 164, 166 are deployed so that material is dumped into the cart. The cart is then shifted to the left of FIG. 4, and motor 68 is operated to extend elongate member 112 and bucket 114 to the bottom surface again. It is contemplated that apparatus 10 will shift continuously along a path 242 extending from reference point 240 so that successive volumes of bottom material are successively removed. In order for this to occur, from the time that bucket 114 is operated to fully close upon a payload, and retracted upwardly to dump the load and return for penetrating into the ground, apparatus 10 will have traveled forwardly a distance approximately (within, say, twenty-five percent) of the width of the bucket. For purposes of general definition, the width of bucket 114 falls generally within width W shown in FIG. 10.

In continuous operation as described above, apparatus 10 proceeds generally along path 242, by means of drive unit 236, until some second preselected datum, such as indicated at 244, is reached. Of course, first conveying means 14 is operable for receiving material dumped from cart 178 onto conveyors 198, 200 for transport of the material to conveyor belt 210 of second conveying means 16. The material is transferred by conveyor belt 210 onto yet another conveyor 246 for discharge to some convenient land or shore region schematically indicated at 248.

After apparatus 10 is positioned generally over preselected datum 244, first conveying means 14 is shifted, upon suitable actuation of drive unit 216, to the right (as shown in FIG. 1) a distance approximately equal to the length of bucket 114. For purposes of general definition, the length of bucket 114 is designated at L in FIG. 10. Then, with drive unit 216 deactivated and with drive unit 236 activated, apparatus 10 is advanced along a return path 250 in a direction generally parallel to the direction of conveyance of first conveying means 14 toward second conveying means 16. Similarly, another preselected reference datum, generally indicated at 252, is reached, and shifting of first conveying means 14 occurs and a new path is traveled by apparatus 10. Successively, travel of apparatus 10 relative to first conveying means 14 occurs with intermittent shifting of the first conveying means relative to the second conveying means occurring prior to reversal of direction of apparatus 10 relative to first conveying means 14. Thus, it may be appreciated that a substantially large, preselected volume of bottom material over a defined area may be removed by apparatus 10 used in conjunction with conveying apparatus 12.

From the above description, it should be readily apparent that the present invention provides several distinct and important advantages. First of all, precise control and bottom surface placement of bucket 114 is ensured because the bucket will not twist or reorient about a vertical axis or an axis corresponding to the longitudinal axis of elongate member 112. Carriage 98, which engages guides 100, 102, constrains any tendency of the bucket to twist, thereby ensuring precise, guided placement of the bucket onto the bottom surface. In addition, because of the substantial weight of elongate member 112 and because the elongate member is directed vertically toward the bottom surface, a ramming or penetrating action is achieved which drives the bucket into the bottom surface, ensuring complete penetration of jaws 164, 166. Thus, usually a full payload will be realized with every bite of the bucket.

Another significant advantage of the present invention resides in the upright construction of tower 22 so that vertical lowering of elongate member 112 and bucket 14 is permitted to occur. The tower may be constructed upwardly of sixty to seventy feet, and elongate member 112 may be thirty-five to forty feet long. The vertical construction of tower 22 permits a carriage to be mounted thereon, and connected to cables so that the carriage is precisely shifted in a vertical direction. If only cables were employed, as in conventional dredges, precise vertical shifting would not always occur, and a bucket would often tend to tip over. Another feature of the present invention which deserves note is the fact that bucket 114, when contacting an uneven bottom surface, (as by contacting random boulders, for instance) will reorient so as to be driven to face an area of the bottom surface as shown in FIG. 12. With elongate member 112 being rigid, it can be appreciated that the bucket will be driven or rammed into the bottom surface so that complete penetration will occur. Thus, it can be appreciated that realization of full payloads is the usual result.

Another significant advantage of the present invention resides in the fact that elongate member 112 is pivotally connected to carriage 98 by means of pin 148. Thus, elongate member 112 will be permitted to pivot about a hoizontal axis extending generally perpendicularly to the longitudinal axis of the elongate member. This pivot axis is generally perpendicular to the forward and reverse direction of travel of apparatus 10 and is necessary in order to compensate, at least slightly, for uneven bottom surface as well as to permit continuous movement of apparatus 10.

Further advantages of the present invention are also readily apparent. For instance, it has been noted that significant power savings in raising a payload of bottom material (such as sand and gravel) may be realized if second carriage 106, taken together with counterweight 108, define a total weight generally equal to the combined weight of carriage 98, elongate member 112, bucket 114 and approximately fifty percent (50%) of the weight of a full bucket. In this regard, determinations have been made for a bucket having a capacity of approximately five cubic yards.

Of particular advantage in the present invention is the use of the interconnected and relatively shiftable first and second conveying means. While the above description has proceeded with an assumption that a square or rectangular region is to be trenched, it should be recognized that first conveying means 14 and second conveying means 16 may be positioned, relative to one another, other than at right angles, as shown in FIG. 1. For instance, it may be desired to remove bottom material from adjacent a region which would prevent the perpendicular positioning of the first and second conveying means. In such a situation, repositioning of the drive units and guide wheels may be necessary. In addition, it is contemplated that first conveying means 14 and second conveying means 16 may be selectively lengthened or shortened, as desired, in order to permit digging of the bottom material over a selected bottom surface area.

While the invention has been particularly shown and described with reference to the foregoing preferred embodiment, it will be understood by those skilled in the art that other changes in form and detail may be made therein without departing from the spirit and scope of the invention as defined in the claims.

It is claimed and desired to secure by Letters Patent:

1. Apparatus for removing bottom material from beneath the surface of a body of water comprising:

floatable base means;

tower means mounted on said base means for extending vertically upwardly therefrom, said tower means including guide means;

carriage means mounted on said tower means operable for substantially vertical shifting along said guide means;

rigid means including an elongate member having a bucket mounted adjacent one end thereof, the other end of said elongate member being pivotally connected to said carriage means and suspended therefrom to permit pivotal movement of said elongate member about a horizontal axis extending generally perpendicularly to the longitudinal axis of said elongate member, said elongate member also being substantially constrained from rotation about a vertical axis; and power-driven means mounted adjacent said tower means operable for selectively shifting said carriage means in a substantially vertical direction to effect raising and lowering of said bucket.

2. The apparatus of claim 1 wherein said guide means are spaced apart and vertically extend on said tower means for receiving said carriage means and preventing same from substantial twisting relative to said tower means.

3. The apparatus of claim 2 wherein said carriage means includes slide elements provided thereon for engaging said guide means.

4. The apparatus of claim 2 wherein said carriage means is provided with shock absorbing means for cushioning impact between said carriage means and said tower means.

5. The apparatus of claim 1 wherein said bucket is pivotally connected to said elongate member for pivotal movement about an axis extending generally perpendicularly to the longitudinal axis of said elongate member.

6. Apparatus for removing material from beneath the surface of body of water comprising:

first conveying means dimensioned for extending over a portion of the water surface;

floatable base means connected to said first conveying means including first drive means operable for selectively shifting said base means in a direction substantially parallel to the direction of conveyance of said first conveying means;

second conveying means disposed generally perpendicularly relative to said first conveying means, said first conveying means being connected to said second conveying means and including second drive means operable for selectively shifting said first conveying means in a direction generally parallel to the direction of conveyance of said second conveying means;

tower means mounted on said base means for extending vertically upwardly therefrom, said tower means including guide means;

carriage means mounted on said tower means operable for substantially vertical shifting along said guide means;

rigid means including an elongate member having a bucket mounted adjacent one end thereof, the other end of said elongate member being pivotally connected to said carriage means and suspended therefrom to permit pivotal movement of said elongate member about a horizontal axis extending generally perpendicularly to the longitudinal axis of said elongate member, said elongate member also being substantially constrained from rotation about a vertical axis; and power-driven means mounted adjacent said tower means operable for selectively shifting said carriage means in a substantially vertical direction to effect raising and lowering of said bucket.

7. The apparatus of claim 6 wherein transfer means are provided on said base means operable for receiving material from said bucket and transferring the material to said first conveying means for subsequent transfer to said second conveying means.

8. The apparatus of claim 7 wherein cart means are provided on said base means for initially receiving material from said bucket and subsequently discharging the material onto said transfer means.

9. The apparatus of claim 8 wherein said cart means is operable for selective shifting from a pre-spot position, relative to said bucket, to a loading position beneath said bucket when said bucket is raised a predetermined height for receiving material from said bucket.

10. The apparatus of claim 6 wherein said guide means are spaced apart and vertically extend on said tower means for receiving said carriage means and preventing same from substantial twisting relative to said tower means.

11. The apparatus of claim 10 wherein said carriage means includes slide elements provided thereon for engaging said guide means.

12. The apparatus of claim 10 wherein said carriage means is provided with shock absorbing means for cushioning impact between said carriage means and said tower means.

13. The apparatus of claim 6 wherein said bucket is pivotally connected to said elongate member for pivotal movement about an axis extending generally perpendicularly to the longitudinal axis of said elongate member.

14. Apparatus for removing bottom material from beneath the surface of a body of water comprising:

floatable base means;

tower means mounted on said base means for extending vertically upwardly therefrom, said tower means including guide means;

carriage means mounted on said tower means operable for substantially vertical shifting along said guide means;

rigid means including an elongate member having a bucket mounted adjacent one end thereof, the other end of said elongate member being connected to said carriage means with said bucket being substantially constrained from rotation about a vertical axis;

power-driven means mounted adjacent said tower means operable for selectively shifting said carriage means in a substantially vertical direction to effect raising and lowering of said bucket, said power-driven means being mounted adjacent the top of said tower means and including drum means and cable means trained therearound, said cable means having one end thereof extending to said carriage means for connection thereto with the other end of said cable means being connected to a counterweight; and second carriage means provided on an opposite side of said tower means operable for substantially vertical shifting along second guide means provided on the other side of said tower means, said counterweight being connected to said second carriage means, said second carriage means being connected to said cable means.

15. The apparatus of claim 14 wherein said second carriage means and said counterweight, taken together, determine a total weight generally equal to the combined weight of said carriage means, said elongate member, said bucket and approximately fifty percent of the weight of a typical fully loaded bucket of bottom material.

16. Apparatus for removing material from beneath the surface of a body of water comprising:

first conveying means dimensioned for extending over a portion of the water surface;

floatable base means connected to said first conveying means including first drive means operable for selectively shifting said base means in a direction substantially parallel to the direction of conveyance of said first conveying means;

second conveying means disposed generally perpendicularly relative to said first conveying means, said first conveying means being connected to said second conveying means and including second drive means operable for selectively shifting said first conveying means in a direction generally parallel to the direction of conveyance of said second conveying means;

tower means mounted on said base means for extending vertically upwardly therefrom, said tower means including guide means;

carriage means mounted on said tower means operable for substantially vertical shifting along said guide means;

rigid means having a bucket mounted thereon, said rigid means being connected to said carriage means and substantially constrained from rotation about a vertical axis;

power-driven means mounted adjacent said tower means operable for selectively shifting said carriage means in a substantially vertical direction to effect raising and lowering of said bucket, said power-driven means being mounted adjacent the top of said tower means and including drum means and cable means trained therearound, said cable means having one end thereof extending to said carriage means for connection thereto, the other end of said cable means being connected to a counterweight; and second carriage means provided on an opposite side of said tower means operable for substantially vertical shifting along second guide means provided on the other side of said tower means, said counterweight being connected to said second carriage means, said second carriage means being connected to said cable means.

17. The apparatus of claim 16 wherein said second carriage means and said counterweight, taken together, determine a total weight generally equal to the combined weight of said carriage means, said rigid member, said bucket and approximately fifty percent of a typical fully loaded bucket of bottom material.

* * * * *